US009165519B1

(12) United States Patent
Lin et al.

(10) Patent No.: US 9,165,519 B1
(45) Date of Patent: Oct. 20, 2015

(54) DISPLAY PANEL AND DRIVING METHOD THEREOF

(71) Applicant: Au Optronics Corporation, Hsinchu (TW)

(72) Inventors: Hung-Che Lin, Hsinchu (TW); Sheng-Ju Ho, Hsinchu (TW); Chih-Chieh Wang, Taoyuan County (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 14/328,718

(22) Filed: Jul. 11, 2014

(30) Foreign Application Priority Data

Mar. 27, 2014 (TW) ..... 103111507 A

(51) Int. Cl.
*G09G 3/36* (2006.01)
*G09G 3/20* (2006.01)

(52) U.S. Cl.
CPC ..... *G09G 3/3648* (2013.01); *G09G 3/2074* (2013.01); *G09G 2300/0465* (2013.01); *G09G 2310/0289* (2013.01)

(58) Field of Classification Search
CPC ..... C09G 3/36; C09G 3/3607; C09G 2300/0426; C09G 230/0443
USPC ..... 345/100, 76, 87, 88, 89, 96, 690, 691, 345/698
See application file for complete search history.

(56) References Cited

U.S. PATENT DOCUMENTS

| | | | | |
|---|---|---|---|---|
| 8,803,927 | B2 | 8/2014 | Wu et al. | |
| 2005/0225521 | A1* | 10/2005 | Leo et al. | 345/87 |
| 2006/0001617 | A1* | 1/2006 | Shin et al. | 345/76 |
| 2006/0267897 | A1* | 11/2006 | Lin | 345/96 |
| 2007/0139327 | A1* | 6/2007 | Liu et al. | 345/89 |
| 2008/0246038 | A1 | 10/2008 | Um et al. | |
| 2009/0027581 | A1 | 1/2009 | You et al. | |
| 2009/0135322 | A1 | 5/2009 | Kim et al. | |
| 2011/0261277 | A1* | 10/2011 | Chung et al. | 349/43 |
| 2011/0285950 | A1* | 11/2011 | Su et al. | 349/139 |
| 2012/0105735 | A1* | 5/2012 | Tsubata | 348/731 |
| 2012/0218322 | A1* | 8/2012 | Shiomi | 345/690 |
| 2012/0320099 | A1 | 12/2012 | Wu et al. | |
| 2013/0063667 | A1* | 3/2013 | Sakai | 348/731 |
| 2014/0111410 | A1* | 4/2014 | Guo | 345/88 |
| 2014/0333688 | A1* | 11/2014 | Hung et al. | 345/698 |
| 2015/0002560 | A1* | 1/2015 | Kwon et al. | 345/691 |

FOREIGN PATENT DOCUMENTS

TW 201250667 12/2012

* cited by examiner

*Primary Examiner* — Fred Tzeng
(74) *Attorney, Agent, or Firm* — Jianq Chyun IP Office

(57) ABSTRACT

A display panel and a driving method thereof are provided. The display panel includes a plurality of scan lines, a plurality of first data lines, a plurality of second data lines and a plurality of pixels. The scan lines receive a plurality of scan signals. The pixels are arranged in an array and respectively have a first sub-pixel and a second sub-pixel. In each column, the first sub-pixel of i-th odd pixel electronically connects (2i−1)-th scan line and a corresponding first data line, the second sub-pixel of i-th odd pixel electronically connects (2i−1)-th and (2i)-th scan line and the corresponding first data line, the first sub-pixel of i-th even pixel electronically connects (2i)-th scan line and a corresponding second data line, and the second sub-pixel of i-th even pixel electronically connects (2i)-th and (2i+1)-th scan line and the corresponding second data line, wherein the i is a positive integer.

11 Claims, 3 Drawing Sheets

DISPLAY PANEL AND DRIVING METHOD THEREOF

CROSS-REFERENCE TO RELATED APPLICATION

This application claims the priority benefit of Taiwan application serial no. 103111507, filed on Mar. 27, 2014. The entirety of the above-mentioned patent application is hereby incorporated by reference herein and made a part of this specification.

BACKGROUND OF THE INVENTION

1. Field of the Invention

The invention relates to a display technology, and particularly relates to a display panel and a driving method thereof.

2. Description of Related Art

Owing to the advanced development in the semiconductor and optoelectronic technologies, the display technology is well-developed nowadays. When it comes to displays, the technology for liquid crystal displays (LCDs), which has the advantages of being light, thin, short and compact, power saving, radiation-free, full color, and portable, is the most matured and popularized.

To make the display quality of LCDs more preferable, the development of LCDs nowadays aims at a high contrast ratio, no gray scale inversion, high luminance, high color saturation, a quick responding speed, and a wide viewing angle. Regarding the technology of wide viewing angle, multi-domain vertically alignment (MVA) displays are commonly used.

In a MVALCD display, each pixel is at least divided into two sub-pixels to make compensation in correspondence with the color washout of the user, wherein voltages stored in the sub-pixels are usually different. To adjust the voltages of the sub-pixels, a conventional way is to make the adjustment by using a power-storing function of the capacitor. However, the capacitor takes up the circuit area of the pixel, and consequently influences the aperture ratio of the pixel. Namely, the display effect of the display panel is influenced. Therefore, to allow the MVALCD display to function normally, how to improve the aperture ratio has become an important issue to improve the display effect.

SUMMARY OF THE INVENTION

The invention provides a display panel capable of improving an aperture ratio of pixels.

The display panel of the invention includes a plurality of scan lines, a plurality of first data lines, a plurality of second data lines, and a plurality of pixels. The scan lines receive a plurality of scan signals. Each of the pixels includes a first sub-pixel and a second sub-pixel. In addition, the pixels are arranged in an array. In the pixels of each column, the first sub-pixel of the i-th odd pixel is electrically connected with the (2i−1)-th scan line and the corresponding first data line, the second sub-pixel of the i-th odd pixel is electrically connected with the (2i−1)-th scan line, the 2i-th scan line, and the corresponding first data line, the first sub-pixel of the i-th even pixel is electrically connected with the (2i)-th scan line and the corresponding second data line, the second sub-pixel of the i-th even pixel is electrically connected with the (2i)-th scan line, the (2i+1)-th scan line, and the corresponding second data line, and i is a positive integer. Each of the first sub-pixels includes a first transistor having a first end, a second end, and a control end. The first end of the first transistor is electrically connected with the corresponding first data line or the corresponding second data line, and the control end of the first transistor is electrically connected with the (2i−1)-th scan line or the (2i)-th scan line. Moreover, each of the second sub-pixels includes a second transistor and a third transistor. The second transistor has a first end, a second end, and a control end. The first end of the second transistor is electrically connected with the corresponding first data line or the corresponding second data line, and the control end of the second transistor is electrically connected with the (2i−1)-th scan line or the (2i)-th scan line. The third transistor has a first end, a second end, and a control end. The first end of the third transistor is electrically connected with the second end of the second transistor, and the control end of the third transistor is electrically connected with the (2i)-th scan line or the (2i+1)-th scan line.

In an embodiment of the invention, the first sub-pixel of the i-th odd pixel receives a first data voltage transmitted by the corresponding first data line based on the scan signal transmitted by the (2i−1)-th scan line, and the second sub-pixel of the i-th odd pixel receives a second data voltage transmitted by the corresponding first data line based on the scan signals transmitted by the (2i−1)-th scan line and the (2i)-th scan line.

In an embodiment of the invention, the first sub-pixel of the i-th even pixel receives a third data voltage transmitted by the corresponding second data line based on the scan signal transmitted by the (2i)-th scan line, and the second sub-pixel of the i-th even pixel receives a fourth data voltage transmitted by the corresponding second data line based on the scan signals transmitted by the (2i)-th scan line and the (2i+1)-th scan line.

In an embodiment of the invention, each of the first sub-pixels further includes a first liquid crystal capacitor and a first storage capacitor. The first liquid crystal capacitor is electrically connected between the second end of the first transistor and a common voltage. The first storage capacitor is electrically connected between the second end of the first transistor and the common voltage.

In an embodiment of the invention, each of the second sub-pixels further includes a second liquid crystal capacitor and a second storage capacitor. The second liquid crystal capacitor is electrically connected between the second end of the third transistor and the common voltage. The first storage capacitor is electrically connected between the second end of the third transistor and the common voltage.

A driving method of a display panel of the invention includes steps as follows. A display panel that includes a plurality of scan lines and a plurality of pixels having a first sub-pixel and a second sub-pixel each is provided. In addition, the first sub-pixel of the i-th odd pixel in each column is electrically connected with the (2i−1)-th scan line, the second sub-pixel of the i-th odd pixel in each column is electrically connected with the (2i−1)-th scan line and the (2i)-th scan line, the first sub-pixel of the i-th even pixel in each column is electrically connected with the (2i)-th scan line, and the second sub-pixel of the i-th even pixel in each column is electrically connected with the (2i)-th scan line and the (2i+1)-th scan line, and i is a positive integer. The (2i)-th scan line and the (2i+1)-th scan line are enabled in a first period. The (2i−1)-th scan line and the (2i)-th scan line are enabled in a second period. The (2i−1)-th scan line is enabled in a third period. In addition, the first period is prior to the second period, and the second period is prior to the third period.

In an embodiment of the invention, the driving method further includes enabling the (2i−1)-th scan line in the first period.

In an embodiment of the invention, the driving method further includes enabling the (2i+2)-th scan line and the (2i+3)-th scan line in the third period.

In an embodiment of the invention, the driving method further includes disabling the (2i−1)-th scan line in the first period.

In an embodiment of the invention, the driving method further includes disabling the (2i+1)-th scan line in the second period.

In an embodiment of the invention, the driving method further includes disabling the (2i)-th scan line and the (2i+1)-th scan line in the third period.

Based on the above, in the display panel according to the embodiments of the invention, the first and second sub-pixels of the two vertically adjacent pixels share three scan lines. Therefore, the number of wires in the display panel may be reduced. In addition, the pixel voltages of the sub-pixels may be transmitted through the corresponding first or second data line. Therefore, the voltage-adjusting capacitor may be omitted in the pixel. Based on the above, the circuit area that the first and second sub-pixels may use relatively increases. Therefore, the aperture ratio of the first and second sub-pixels may be increased.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
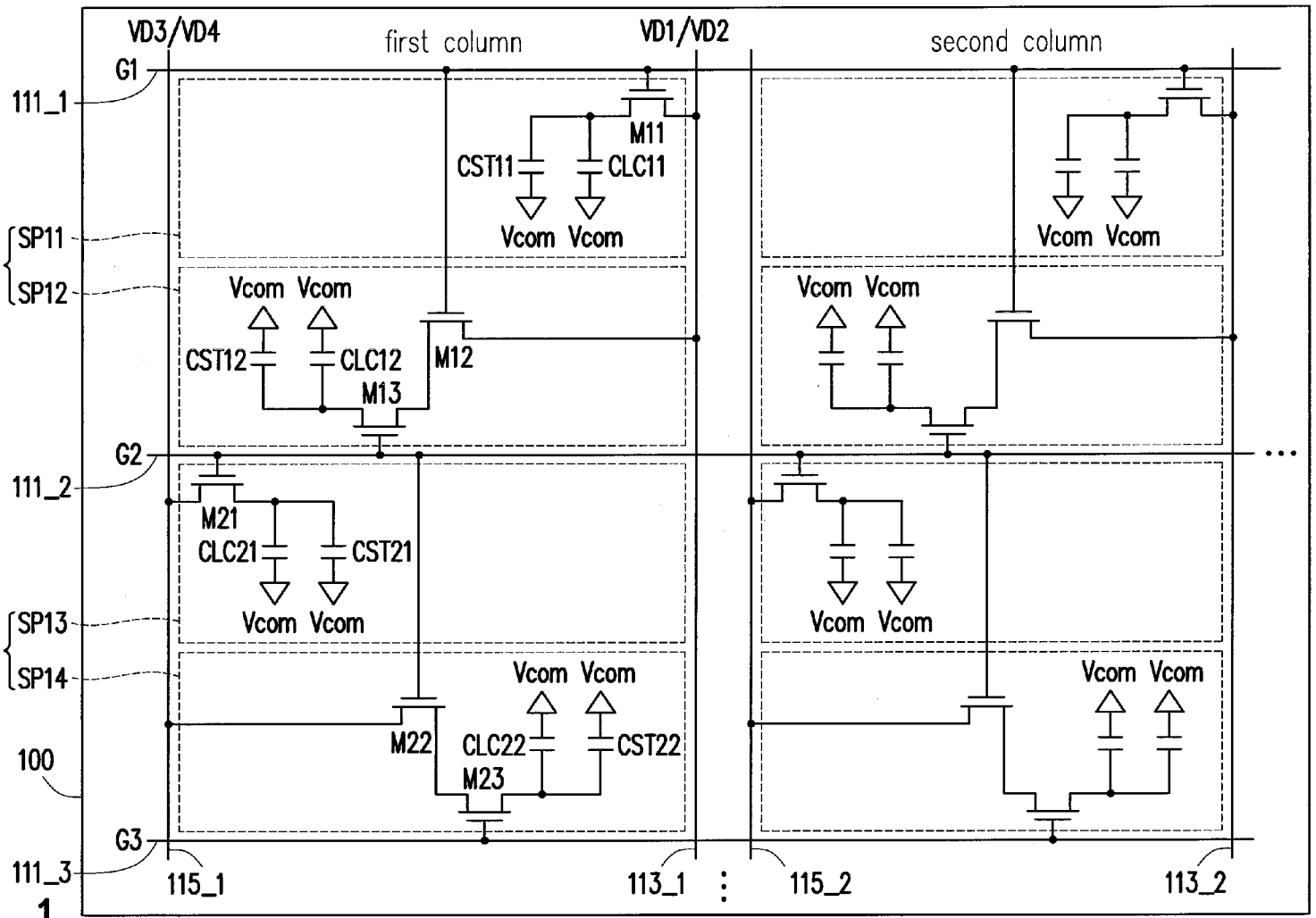
FIG. 1 is a schematic circuit view illustrating a display panel according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic circuit view illustrating a display panel according to an embodiment of the invention. Referring to FIG. 1, in this embodiment, a display panel 100 includes a plurality of scan lines (e.g. 111_1 to 111_3), a plurality of first data lines (e.g. 113_1 to 1132), a plurality of second data lines (e.g. 115_1 to 115_2), and a plurality of pixels (e.g. OPX1 and EPX1). The scan lines 111_1 to 111_3 are configured to receive a plurality of scan signals (e.g. G1 to G3). The scan line 111_01 receives the scan signal G1, for example, the scan line 111_2 receives the scan signal G2, for example, and so on so forth. However, the embodiments of the invention are not limited thereto.

The first data lines 113_1 to 113_2 and the second data lines 115_1 to 115_2 are configured to sequentially receive a plurality of data voltages (e.g. data voltages VD1 to VD4). In addition, the first data line 113_1 sequentially receives the first data voltage VD1 and the second data voltage VD2, for example, the second data line 115_1 sequentially receives the third data voltage VD3 and the fourth data voltage VD4, for example, and so on so forth. However, the embodiments of the invention are not limited thereto.

In this embodiment, taking pixels in the first column for example, the first odd pixel OPX1 has a first sub-pixel SP11 and a second sub-pixel SP12, for example, and the first even pixel EPX1 has a first sub-pixel SP13 and a second sub-pixel SP14, for example. The first sub-pixel SP11 of the odd pixel OPX1 is electrically connected with the first scan line 111_1 and the corresponding first data line 113_1 the second sub-pixel SP12 of the odd pixel OPX1 is electrically connected with the first scan line 111_1, the second scan line 111_2, and the corresponding first data line 113_1. The first pixel SP13 of the even pixel EPX1 is electrically connected with the second scan line 111_2 and the corresponding second data line 115_1, the second sub-pixel SP14 of the even pixel EPX1 is electrically connected with the second scan line 111_2, the third scan line 111_3, and the corresponding second data line 115_1. Circuit structures of remaining of the odd and even pixels may be referred to the above, so no further details will be described hereinafter.

Based on the above, in the embodiment of the invention, the first sub-pixel (e.g. SP11) of the i-th odd pixel (e.g. OPX1) is electrically connected with the (2i−1)-th scan line (e.g. 111_1) and the corresponding first data line (e.g. 113_1), the second sub-pixel (e.g. SP12) of the i-th odd pixel (e.g. OPX1) is electrically connected with the (2i−1)-th scan line (e.g. 111_1), the (2i)-th scan line (e.g. 111_2), and the corresponding first data line (e.g. (113_1), the first sub-pixel (e.g. SP13) of the i-th even pixel (e.g. EPX1) is electrically connected with the (2i)-th scan line (e.g. 111_2) and the corresponding second data line (e.g. 115_1), and the second sub-pixel (e.g. SP14) of the i-th even pixel (e.g. EPX1) is electrically connected with the (2i)-th scan line (e.g. 111_2), the (2i+1)-th scan line (e.g. 111_3), and the corresponding second data line (e.g. 115_1). In addition, i is a positive integer.

In this embodiment, circuit structures of the pixels in the second column are the same as those of the pixels in the first column. However, in other embodiments, the circuit structures of the pixels in the second column may be horizontally mirrored from the circuit structures of the pixels in the first column (based on a direction of the figure, for example). However, the embodiments of the invention are not limited thereto.

More specifically speaking, the first sub-pixel 11 of the first odd pixel OPX1 includes a first transistor M11, a first liquid crystal capacitor CLC11, and a first storage capacitor CST11. A first end of the first transistor M11 is electrically connected the corresponding first data line 113_1, and a control end of the first transistor M11 is electrically connected with the scan line 111_1. The first liquid crystal capacitor CLC11 is electrically connected between a second end of the first transistor M11 and a common voltage Vcom. The first storage capacitor CST11 is electrically connected between the second end of the first transistor M11 and the common voltage Vcom.

The second sub-pixel SP12 of the first odd pixel OPX1 includes a second transistor M12, a third transistor M13, a second liquid crystal capacitor CLC12, and a second storage capacitor CST12. A first end of the second transistor M12 is electrically connected the corresponding first data line 113_1, and a control end of the second transistor M12 is electrically connected with the scan line 111_1. A first end of the third transistor M13 is electrically connected with a second end of the second transistor M12, and a control end of the third transistor M13 is electrically connected with the scan line 111_2. The second liquid crystal capacitor CLC12 is electrically connected between the second end of the third transistor M13 and the common voltage Vcom. The second storage capacitor CST12 is electrically connected between the second end of the third transistor M13 and the common voltage Vcom.

The first sub-pixel SP13 of the first even pixel EPX1 includes a first transistor M21, a first liquid crystal capacitor CLC21, and a first storage capacitor CST21. A first end of the first transistor M21 is electrically connected with the corresponding second data line 115_1, and a control end of the first transistor M21 is electrically connected with the scan line 111_2. The first liquid crystal capacitor CLC21 is electrically connected between a second end of the first transistor M21 and the common voltage Vcom. The first storage capacitor CST21 is electrically connected between the second end of the first transistor M21 and the common voltage Vcom.

The second sub-pixel SP14 of the first even pixel EPX1 includes a second transistor M22, a third transistor M23, a first liquid crystal capacitor CLC22, and a first storage capacitor CST 22. A first end of the second transistor M22 is electrically connected with the corresponding second data line 115_1, and a control end of the second transistor M22 is electrically connected with the scan line 111_2. A first end of the third transistor M23 is electrically connected with a second end of the second transistor M22, and a control end of the third transistor M23 is electrically connected with the scan line 111_3. The second liquid crystal capacitor CLC22 is electrically connected between the second end of the third transistor M23 and the common voltage Vcom. The second storage capacitor CST22 is electrically connected between the second end of the third transistor M23 and the common voltage Vcom.

Based on the above, the first sub-pixel SP11 of the odd pixel OPX1 receives the first data voltage VD1 transmitted by the corresponding first data line 113_1 based on the scan signal G1 transmitted by the scan line 111_1, and the second sub-pixel SP12 of the odd pixel OPX1 receives the second data voltage VD2 transmitted by the corresponding first data line 111_1 based on the scan signals G1 and G2 transmitted by the scan lines 111_1 and 111_2. The first sub-pixel SP13 of the even pixel EPX1 receives the third data voltage VD3 transmitted by the corresponding second data line 115_1 based on the scan signal G2 transmitted by the scan line 111_2, and the second sub-pixel SP14 of the even pixel EPX1 receives the fourth data voltage VD4 transmitted by the corresponding second data line 115_1 based on the scan signals G2 and G3 transmitted by the scan lines 111_2 and 111_3.

In this embodiment, the sub-pixels SP11 to SP14 share the three scan lines 111_1 to 111_3. Thus, a number of wires in the display panel 100 may be reduced. Moreover, pixel voltages of the sub-pixels SP11 to SP14 may be respectively corresponded to the data voltages transmitted by the data lines (e.g. 113_1 or 115_1). Therefore, a voltage-adjusting capacitor may be omitted in the pixel (e.g. OPX1 or EPX1). According to the above, a circuit area that the sub-pixels SP11 to SP14 may use may relatively increase. Therefore, an aperture ratio of the sub-pixels SP11 to SP14 may be increased.

Figure 2:
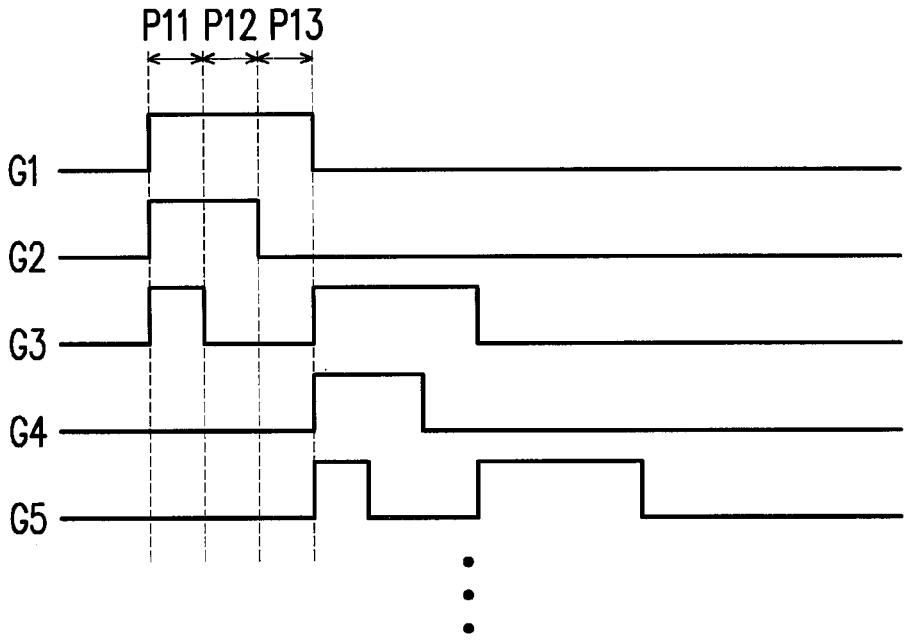
FIG. 2 is a schematic view illustrating driving of a display panel according to an embodiment of the invention.

FIG. 2 is a schematic view illustrating driving of a display panel according to an embodiment of the invention. Referring to FIGS. 1 and 2, in this embodiment, a first period P11 is set to be prior to a second period P12, and the second period P12 is set to be prior to a third period P13. In addition, like or similar elements are referred to by like or similar symbols. In the first period P11, the scan lines 111_1 to 111_3 (corresponding to the (2i−1)-th scan line to (2i+1)-th scan line) are enabled to turn on the transistors M11 to M13 and M21 to M23. At this time, the second data line 1151 may receive the fourth data voltage VD4 to transmit the fourth data voltage VD4 to the second liquid crystal capacitor CLC22 and the second storage capacitor CST22. In addition, the first data line 113_1 may receive an arbitrary voltage (e.g. the data voltage VD1, the data voltage VD2, or a ground voltage). Relevant configuration may be set based on the needs in a circuit design, so the embodiments of the invention are not limited thereto. In addition, the first storage capacitor CST21 also receives the fourth data voltage VD4. Therefore, the fourth data voltage VD4 may be used for pre-charging. In addition, the first storage capacitor CST11 and the second storage capacitor CST12 may receive and use the voltage transmitted by the first data line 113_1 for pre-charging.

In the second period P12, the scan lines 111_1 to 111_2 are enabled (corresponding to the (2i−1)-th scan line and the (2i)-th scan line) to turn on the transistors M11 to M13 and M21 to M22. Therefore, a cross-voltage of the second storage capacitor CST22 may be equivalent to the fourth data voltage VD4. In addition, the scan line 111_3 (corresponding to the (2i+1)-th scan line) is disabled, such that the transistor M23 is turned off. At this time, the first data line 113_1 receives the second data voltage VD2 to transmit the second data voltage VD2 to the second liquid crystal capacitor CLC12 and the second storage capacitor CST12, and the second data line 115_1 receives the third data voltage VD3 to transmit the third data voltage VD3 to the first liquid crystal capacitor CLC21 and the first storage capacitor CST21. In addition, the first storage capacitor CST11 also receives the second data voltage VD2, so the second data voltage VD2 may be used for pre-charging.

In the third period P13, the scan line 111_1 (corresponding to the (2i−1)-th scan line) is enabled, so as to turn on the transistors M11 to M12. Therefore, a cross-voltage of the second storage capacitor CST12 may be equivalent to the second data voltage VD2. In addition, the scan lines 111_2 to 111_3 (corresponding to the (2i)-th scan line and the (2i+1)-th scan line) are disabled, such that the transistors M13 and M21-M23 are turned off, and a cross-voltage of the first storage capacitor CST21 is equivalent to the third data voltage VD3. Here, the first data line 113_1 receives the first data voltage VD1 to transmit the first data voltage VD1 to the first liquid crystal capacitor CLC11 and the first storage capacitor CST11. In addition, the second data line 115_1 may receive an arbitrary voltage (e.g. the data voltage VD3, the data voltage VD4, or the ground voltage). Relevant configuration may be set based on the needs in a circuit design, so the embodiments of the invention are not limited thereto.

Based on the above, the pixel voltages of the sub-pixels SP11 to SP14 may be respectively transmitted by the corresponding data lines (e.g. 113__1 or 115_1).

Figure 3:
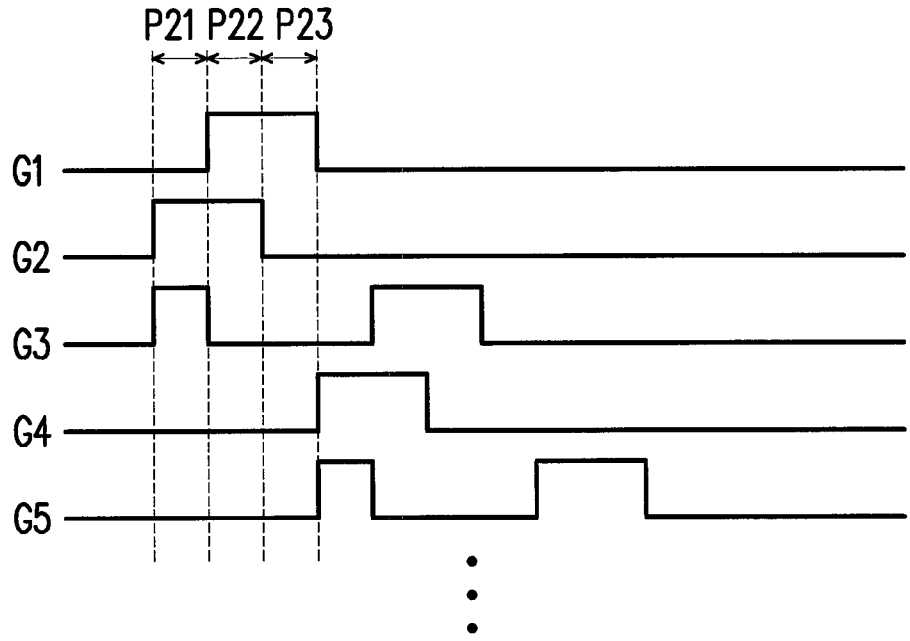
FIG. 3 is a schematic view illustrating driving of a display panel according to another embodiment of the invention.

FIG. 3 is a schematic view illustrating driving of a display panel according to another embodiment of the invention. Referring FIGS. 1-3, like or similar like or similar elements are referred to by like or similar symbols. Operations in a second period P22 and a third period P23 in the embodiment shown in FIG. 3 are approximately the same as operations in the second period P12 and the third period P13 in the embodiment shown in FIG. 2. However, a main difference in the embodiment shown in FIG. 3 is that in a first period P21 of the embodiment shown in FIG. 3, the scan signal G1 is not enabled, so as to reduce an overall power consumption of the display panel 100. Based on the embodiment shown in FIG. 3, writing-in of the data voltage (e.g. VD1 and VD2) is not performed to the first storage capacitor CST11 and the second storage capacitor CST12 in the first period P21. Therefore, the scan signal G1 is set to be disabled so as not to influence operation of the display panel 100.

Figure 4:
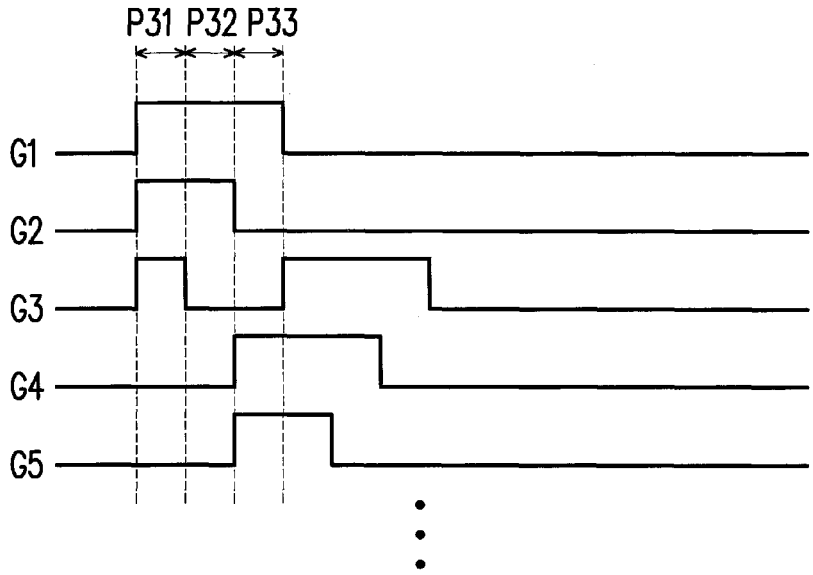
FIG. 4 is a schematic view illustrating driving of a display panel according to still another embodiment of the invention.

FIG. 4 is a schematic view illustrating driving of a display panel according to still another embodiment of the invention. Referring FIGS. 1, 2, and 4, like or similar like or similar elements are referred to by like or similar symbols. Operations in a first period P31 and a second period P32 in the embodiment shown in FIG. 4 are approximately the same as the operations in the first period P11 and the second period P12 in the embodiment shown in FIG. 2. However, a main difference in the embodiment shown in FIG. 4 is that in the third period P33, the scan signals G4 and G5 are enabled, so as to pre-charge a second storage capacitor of a second sub-pixel of a second even pixel. Relevant description may be referred to the description about the second storage capacitor CST22. In the third period P33, the second data line 115_1 may receive a data voltage of the second sub-pixel of the second even pixel, so as to improve an image uniformity of the display panel 100.

Figure 5:
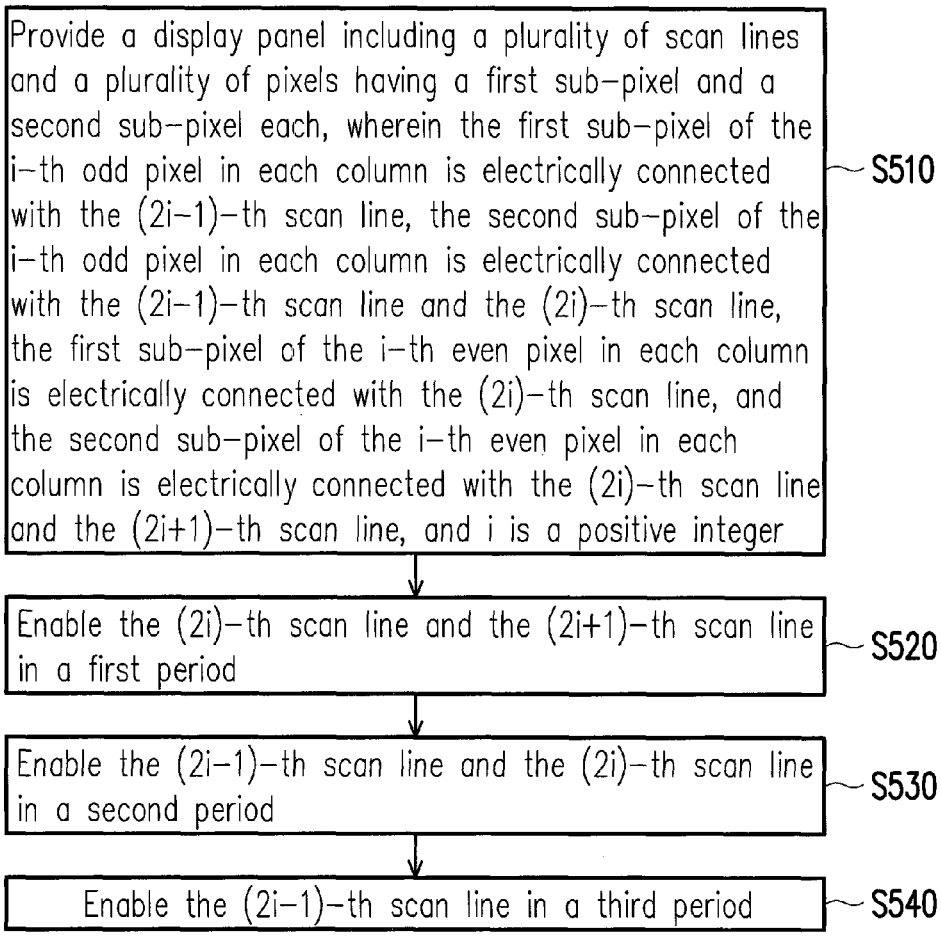
FIG. 5 is a flowchart illustrating a driving method of a display panel according to an embodiment of the invention.

FIG. 5 is a flowchart illustrating a driving method of a display panel according to an embodiment of the invention. Referring to FIG. 5, in this embodiment, the driving method of the display panel includes steps as follows. At Step S510, a display panel is provided. The display panel includes a plurality of scan lines and a plurality of pixels. Each of the pixels has a first sub-pixel and a second sub-pixel. The first sub-pixel of the i-th odd pixel in each column is electrically connected with the (2i−1)-th scan line, the second sub-pixel of the i-th odd pixel in each column is electrically connected with the (2i−1)-th scan line and the (2i)-th scan line, the first sub-pixel of the i-th even pixel in each column is electrically connected with the (2i)-th scan line, and the second sub-pixel of the i-th even pixel in each column is electrically connected with the (2i)-th scan line and the (2i+1)-th scan line. In addition, i is a positive integer. At Step S520, in a first period, the (2i)-th scan line and the (2i+1) scan line are enabled. At Step S530, in a second period, the (2i−1)-th scan line and the (2i) scan line are enabled. At Step S540, in a third period, the (2i−1)-th scan line is enabled. In addition, the first period is prior to the second period, and the second period is prior to the third period. A sequence of Steps S510, S520, S530, and S540 only serves as a descriptive purpose. The embodiments of the invention are not limited thereto. In addition, details about Steps S510, S520, S530, and S540 may be referred to the embodiments shown in FIGS. 1 to 4. Therefore, no further details will be reiterated hereinafter.

In view of the foregoing, in the display panel according to the embodiments of the invention, the first and second sub-pixels of the two vertically adjacent pixels share three scan lines. Therefore, the number of wires in the display panel may be reduced. In addition, the pixel voltages of the sub-pixels may be transmitted through the corresponding first or second data line. Therefore, the voltage-adjusting capacitor may be omitted in the pixel. Based on the above, the circuit area that the first and second sub-pixels may use relatively increases. Therefore, the aperture ratio of the first and second sub-pixels may be increased. Moreover, the (2i−1)-th scan line may be disabled in the first period, so as to reduce the overall power consumption of the display panel. Furthermore, the (2i+2)-th and (2i+3)-th scan lines may be enabled in the third period, so as to improve the pixel uniformity of the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a plurality of scan lines, receiving a plurality of scan signals;

a plurality of first data lines and a plurality of second data lines; and a plurality of pixels, having a first sub-pixel and a second sub-pixel each and arranged in an array, wherein in the pixels of each column, the first sub-pixel of the i-th odd pixel is electrically connected with the (2i−1)-th scan line and the corresponding first data line, the second sub-pixel of the i-th odd pixel is electrically connected with the (2i−1)-th scan line, the 2i-th scan line, and the corresponding first data line, the first sub-pixel of the i-th even pixel is electrically connected with the (2i)-th scan line and the corresponding second data line, the second sub-pixel of the i-th even pixel is electrically connected with the (2i)-th scan line, the (2i+1)-th scan line, and the corresponding second data line, and i is a positive integer;

wherein each of the first sub-pixels comprises:

a first transistor, having a first end, a second end, and a control end, and the first end of the first transistor is electrically connected with the corresponding first data line or the corresponding second data line, and the control end of the first transistor is electrically connected with the (2i−1)-th scan line or the (2i)-th scan line; and each of the second sub-pixels comprises:

a second transistor, having a first end, a second end, and a control end, wherein the first end of the second transistor is electrically connected with the corresponding first data line or the corresponding second data line, and the control end of the second transistor is electrically connected with the (2i−1)-th scan line or the (2i)-th scan line; and a third transistor, having a first end, a second end, and a control end, wherein the first end of the third transistor is electrically connected with the second end of the second transistor, and the control end of the third transistor is electrically connected with the (2i)-th scan line or the (2i+1)-th scan line.

2. The display panel as claimed in claim 1, wherein the first sub-pixel of the i-th odd pixel receives a first data voltage transmitted by the corresponding first data line based on the scan signal transmitted by the (2i−1)-th scan line, and the second sub-pixel of the i-th odd pixel receives a second data voltage transmitted by the corresponding first data line based on the scan signals transmitted by the (2i−1)-th scan line and the (2i)-th scan line.

3. The display panel as claimed in claim 1, wherein the first sub-pixel of the i-th even pixel receives a third data voltage transmitted by the corresponding second data line based on the scan signal transmitted by the (2i)-th scan line, and the second sub-pixel of the i-th even pixel receives a fourth data voltage transmitted by the corresponding second data line based on the scan signals transmitted by the (2i)-th scan line and the (2i+1)-th scan line.

4. The display panel as claimed in claim 1, wherein each of the first sub-pixels further comprises:

a first liquid crystal capacitor, electrically connected between the second end of the first transistor and a common voltage; and a first storage capacitor electrically connected with the second end of the first transistor and the common voltage.

5. The display panel as claimed in claim 1, wherein each of the second sub-pixels further comprises:

a second liquid crystal capacitor, electrically connected between the second end of the third transistor and a common voltage; and a second storage capacitor electrically connected with the second end of the third capacitor and the common voltage.

6. A driving method of a display panel, the method comprising:

providing a display panel comprising a plurality of scan lines and a plurality of pixels having a first sub-pixel and a second sub-pixel each, wherein the first sub-pixel of the i-th odd pixel in each column is electrically connected with the (2i−1)-th scan line, the second sub-pixel of the i-th odd pixel in each column is electrically connected with the (2i−1)-th scan line and the (2i)-th scan line, the first sub-pixel of the i-th even pixel in each column is electrically connected with the (2i)-th scan line, and the second sub-pixel of the i-th even pixel in each column is electrically connected with the (2i)-th scan line and the (2i+1)-th scan line, and i is a positive integer;

enabling the (2i)-th scan line and the (2i+1)-th scan line in a first period;

enabling the (2i−1)-th scan line and the (2i)-th scan line in a second period; and enabling the (2i−1)-th scan line in a third period, wherein the first period is prior to the second period and the second period is prior to the third period.

7. The driving method of the display panel as claimed in claim 6, further comprising:

enabling the (2i−1)-th scan line in the first period.

8. The driving method of the display panel as claimed in claim 7, further comprising:

enabling the (2i+2)-th scan line and the (2i+3)-th scan line in the third period.

9. The driving method of the display panel as claimed in claim 6, further comprising:

disabling the (2i−1)-th scan line in the first period.

10. The driving method of the display panel as claimed in claim 6, further comprising:

disabling the (2i+1)-th scan line in the second period.

11. The driving method of the display panel as claimed in claim 10, further comprising:

disabling the (2i)-th scan line and the (2i+1)-th scan line in the third period.

* * * * *